US006032647A

United States Patent [19]

Sato et al.

[11] Patent Number: 6,032,647

[45] Date of Patent: Mar. 7, 2000

[54] THROTTLE VALVE CONTROL DEVICE

[75] Inventors: Hisaaki Sato, Gunma; Masato Kumagai, Saitama; Tomoaki Araki, Gumna, all of Japan

[73] Assignee: Unisia Jecs Corporation, Atsugi, Japan

[21] Appl. No.: 09/178,479

[22] Filed: Oct. 26, 1998

[30] Foreign Application Priority Data

Dec. 4, 1997 [JP] Japan ..... 9-350006

[51] Int. Cl.[7] ..... F02D 11/10

[52] U.S. Cl. ..... 123/399

[58] Field of Search ..... 123/361, 399, 123/400

[56] References Cited

U.S. PATENT DOCUMENTS

| | | | |
|---|---|---|---|
| 4,500,478 | 2/1985 | Furukawa et al. | 123/361 X |
| 4,586,471 | 5/1986 | Horada et al. | 123/399 |
| 5,161,504 | 11/1992 | Guest, Jr. et al. | 123/399 X |
| 5,490,487 | 2/1996 | Kato et al. | 123/399 |

FOREIGN PATENT DOCUMENTS

| | | |
|---|---|---|
| 63-150449 | 6/1988 | Japan . |
| 4-203219 | 7/1992 | Japan . |
| 6-58174 | 3/1994 | Japan . |

*Primary Examiner*—Tony M. Argenbright
*Attorney, Agent, or Firm*—Foley & Lardner

[57] ABSTRACT

For controlling a throttle valve of an internal combustion engine, there is provided a control valve control device. The device includes a throttle body; a pivot shaft rotatably held by the throttle body and extending across a throttle chamber of the throttle body, the throttle valve being secured to the throttle shaft to pivot therewith; an electric actuator mounted to the throttle body to produce a power to drive the pivot shaft; and a reduction gear mechanism arranged between the electric actuator and the pivot shaft to reduce a speed of an actuation motion applied to the pivot shaft from the actuator. The throttle valve control device further includes a cam lever constituting a part of the reduction gear mechanism, the cam lever being secured to the pivot shaft to pivot therewith and having a cam surface; a cam follower structure pivotally connected to the throttle body and constantly contacting the cam surface to be pivoted; a spring for biasing the cam follower structure in a direction to press a part of the cam follower structure against the cam surface; and a close position adjuster mounted on the cam lever to adjust the close position of the throttle valve. When the cam lever is pivoted in a direction to close the throttle valve, the close position adjuster is brought into abutment with the part of the cam follower structure thereby to stop further pivoting of the cam lever.

15 Claims, 10 Drawing Sheets

THROTTLE VALVE CONTROL DEVICE

BACKGROUND OF THE INVENTION

1. Field of the Invention

The present invention relates in general to throttle valve control devices for controlling a throttle valve of an automotive internal combustion engine in accordance with a depressed degree of an accelerator pedal of an associated motor vehicle, and more particularly to the throttle valve control devices of a type which employs an electric actuator for actuating the throttle valve.

2. Description of the Prior Art

Hitherto, various throttle valve control devices have been proposed and put into practical use particularly in the field of wheeled motor vehicle powered by an internal combustion engine.

Some of the conventional throttle valve control devices have the following construction, which are shown in for example Japanese Patent First Provisional Publications 63-150449, 4-203219 and 6-58174.

That is, a throttle body having therethrough a throttle chamber is disposed in a part of an air intake passage of the engine. A pivot shaft extends across the throttle chamber and is rotatable about its axis. A throttle valve is secured to the pivot shaft to pivot therewith in a direction to open or close the throttle chamber. An electric motor is mounted to the throttle body to actuate the pivot shaft and thus the throttle valve. A reduction gear mechanism is arranged between the electric motor and the pivot shaft to reduce the speed of the actuating motion applied to the pivot shaft from the electric motor. A first biasing means is arranged to constantly bias the throttle valve in the direction to close the throttle chamber. A second biasing means is further arranged to bias the throttle valve against the force of the first biasing means toward an intermediate position, that is, a slightly open given position.

In addition to the above-mentioned elements, a close position adjuster is further employed, which adjusts the close position of the throttle valve. The close position adjuster comprises a projection which is integrally formed on the throttle body, and a stop screw bolt which is threaded with a threaded bore of the projection in such a manner as to adjust the length of a projected part thereof when rotated about an axis thereof. The projected part of the stop screw bolt has a head against which the throttle valve or an element rotating together with the throttle valve abuts when the throttle valve is pivoted back to the close position. Thus, by rotating the stop screw bolt about its axis, the length of the projected part thereof is adjusted and thus the close position of the throttle valve can be adjusted.

When, with the throttle valve assuming the close position, the electric motor is energized, the actuating motion of the electric motor is transmitted to the pivot shaft through the reduction gear mechanism, resulting in that the throttle valve is turned to assume a controlled open position against the force of the first biasing means. With this, the amount of air fed to the engine is controlled, and thus, the output of the engine is controlled.

When in winter the engine is stopped, the electric motor is deenergized. Upon this, the second biasing means forces the throttle valve to assume the intermediate position (viz., slightly open given position) against the force of the first biasing means. With this, undesired freeze-up of the throttle valve (viz., a phenomenon wherein the throttle valve is frozen to a barrel wall) is prevented. In fact, when, in winter, the throttle valve is kept in the close position for a long time, such undesired phenomenon tends to occur.

When, due to some reasons, the electric motor fails to be energized during operation of the engine, the second biasing means forces the throttle valve to assume the intermediate position. With this, undesired engine stop is suppressed, so that the driver can drive the vehicle but slowly to a neighboring service station for repairing the electric motor.

However, even the above-mentioned conventional throttle valve control device have failed to satisfy the users due to many reasons which are for example increase of cost, difficulty of assembly, increase in the number of parts, etc.,.

SUMMARY OF THE INVENTION

It is therefore an object of the present invention to provide an improved throttle valve control device by taking the above into consideration, which satisfies the reduction of cost, simplification of assembly and the reduction in the number of parts.

According to the present invention, there is provided a throttle valve control device which is equipped with both a close position adjuster by which the close position of the throttle valve can be adjusted and an intermediate position adjuster by which the intermediate position (viz., slightly open given position) of the throttle valve can be adjusted.

According to the present invention, there is provided a throttle valve control device for controlling a throttle valve which pivots to assume a close position, an intermediate position and an open position. The throttle valve control device comprises a throttle body having a throttle chamber formed therethrough; a pivot shaft rotatably held by the throttle body and extending across the throttle chamber, the throttle valve being secured to the throttle shaft to pivot therewith; an actuator mounted to the throttle body to produce a power to drive the pivot shaft; a reduction gear mechanism arranged between the actuator and the pivot shaft to reduce a speed of an actuation motion applied to the pivot shaft from the actuator; a cam lever constituting a part of the reduction gear mechanism, the cam lever being secured to the pivot shaft to pivot therewith and having a cam surface; a cam follower structure pivotally connected to the throttle body and constantly contacting the cam surface to be pivoted; biasing means for biasing the cam follower structure in a direction to press a part of the cam follower structure against the cam surface; and a close position adjuster mounted on the cam lever to adjust the close position of the throttle valve, the close position adjuster being brought into abutment with the part of the cam follower structure thereby to stop further pivoting of the cam lever when the cam lever is pivoted in a direction to close the throttle valve.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, embodiments of the present invention will be described in detail with reference to the accompanying drawings.

Figure 1:
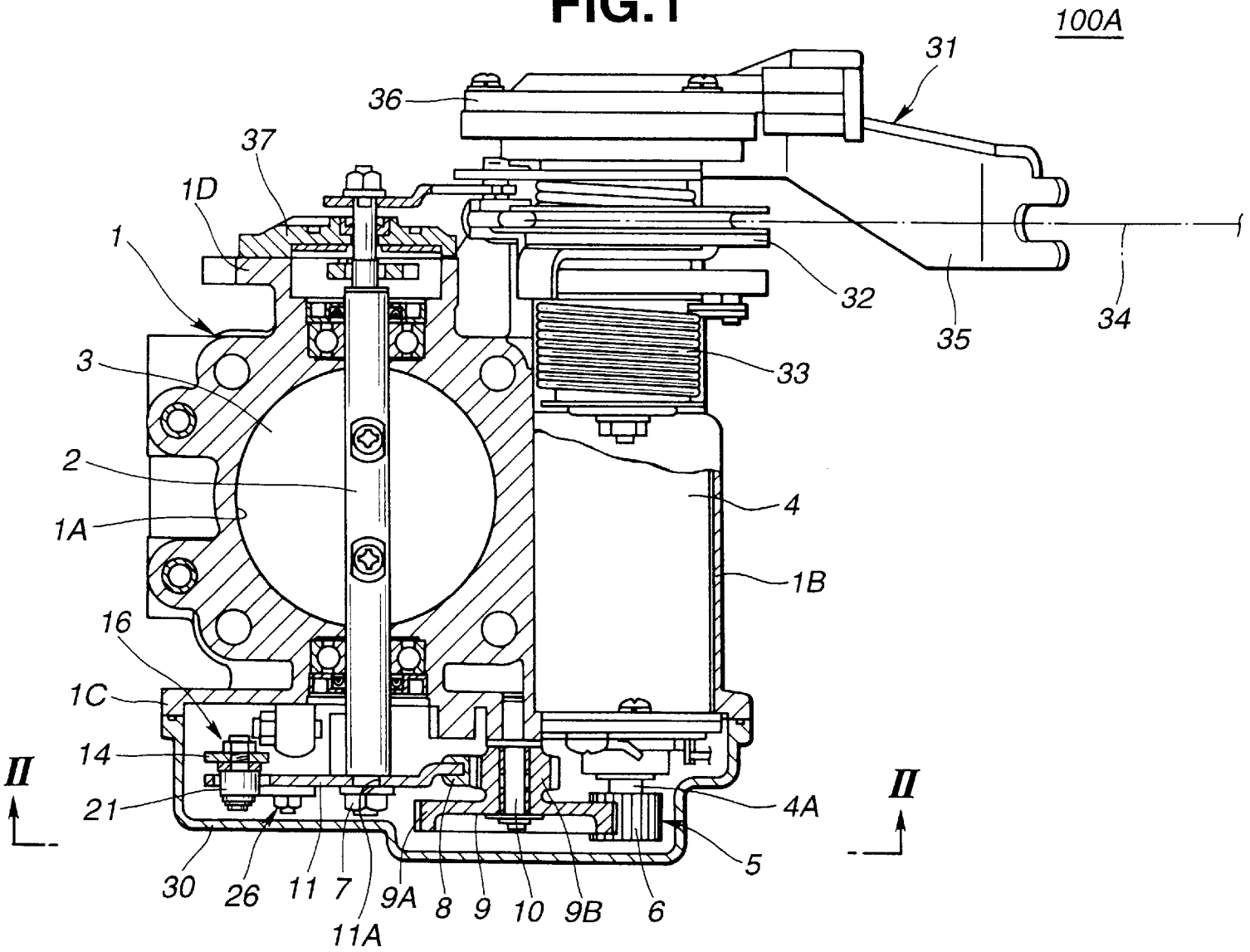
FIG. 1 is a vertically sectioned view of a throttle valve control device which is a first embodiment of the present invention.
Figure 2:
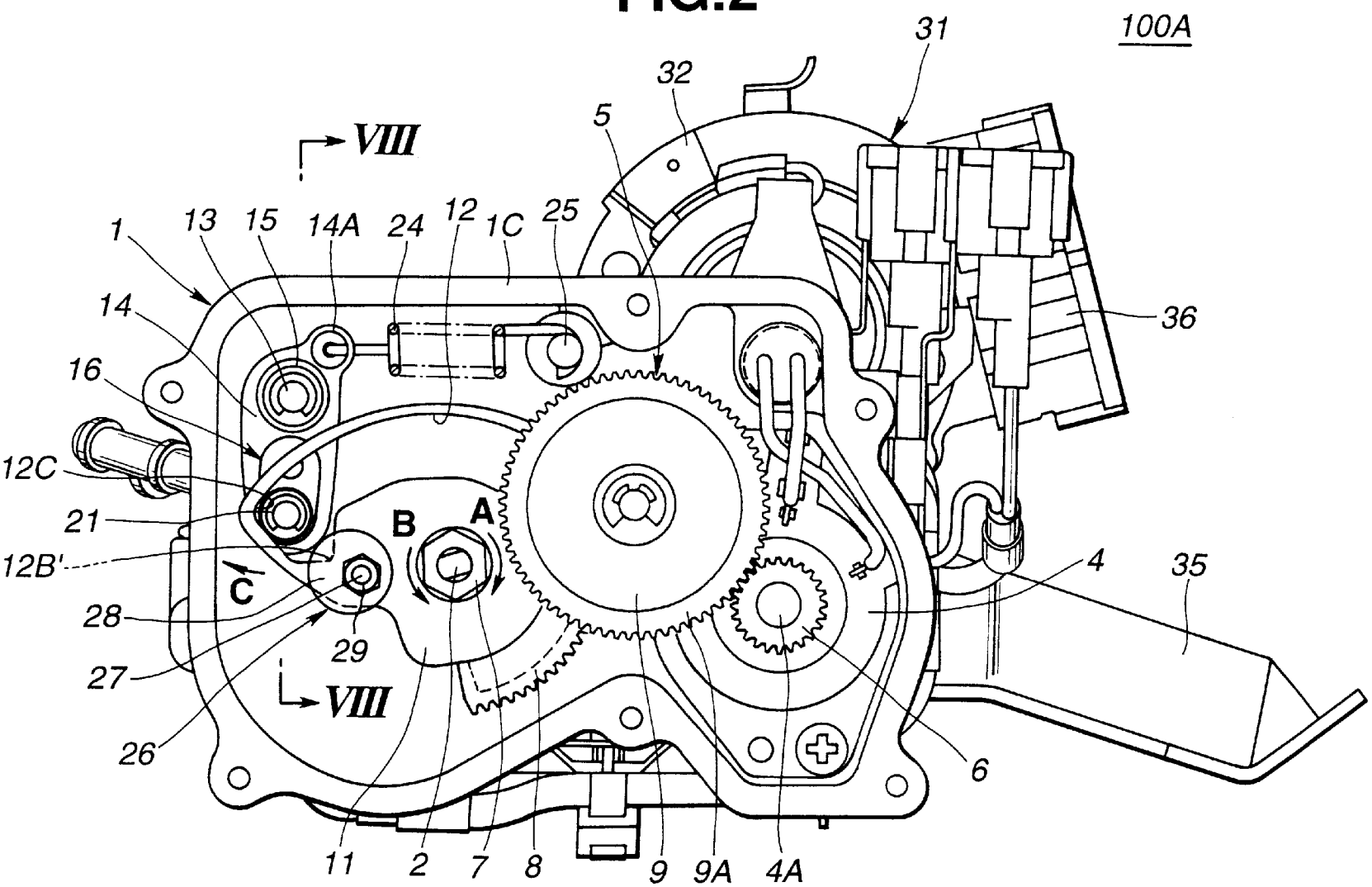
FIG. 2 is a sectional view taken along the line II—II of FIG. 1, showing various parts of a reduction gear mechanism.

Referring to FIGS. 1 to 15, particularly FIGS. 1 and 2, there is shown a throttle valve control device 100A which is a first embodiment of the present invention.

In the drawings, denoted by numeral 1 is a throttle body which constitutes a structural base of the throttle valve control device. The throttle body 1 is constructed of a die-cast aluminum and has a throttle chamber 1A formed therethrough. Although not shown in the drawings, the throttle chamber 1A constitutes a part of an intake air passage which is led to each cylinder of an associated internal combustion engine.

A motor receiving case 1B is integrally possessed by the throttle body 1 for receiving therein an electric motor 4. A gear receiving case 1C is integrally possessed by the throttle body 1. Furthermore, a sensor receiving case 1D is integrally possessed by the throttle body 1. As shown, the gear receiving case 1C and the sensor receiving case 1D are provided at axially opposed positions of a pivot shaft 2, and the motor receiving case 1B is arranged to extend in parallel with the pivot shaft 2.

The pivot shaft 2 is pivotally connected through bearings (no numerals) to the throttle body 1 to extend across the throttle chamber 1A. The pivot shaft 2 is constructed of a mechanically tough metal rod. As shown in FIG. 1, one end of the pivot shaft 2 is projected into the gear receiving case 1C and the other end of the pivot shaft 2 is projected into the sensor receiving case 1D. A circular throttle valve 3 is secured to a middle portion of the pivot shaft 2 to pivot therewith in a direction to open or close the throttle chamber 1A.

Figure 6:
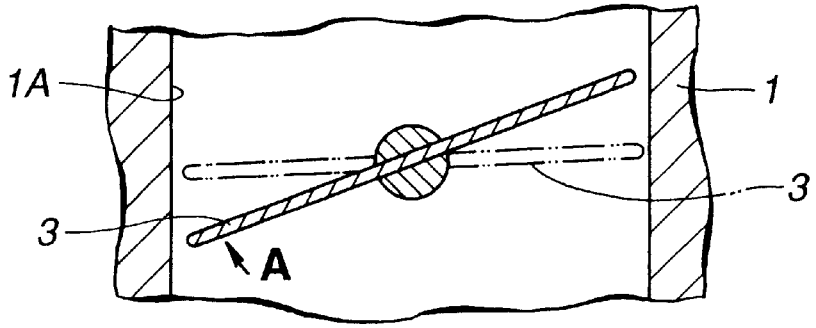
FIG. 6 is a view similar to FIG. 5, but showing the throttle valve assuming the close position.
Figure 7:
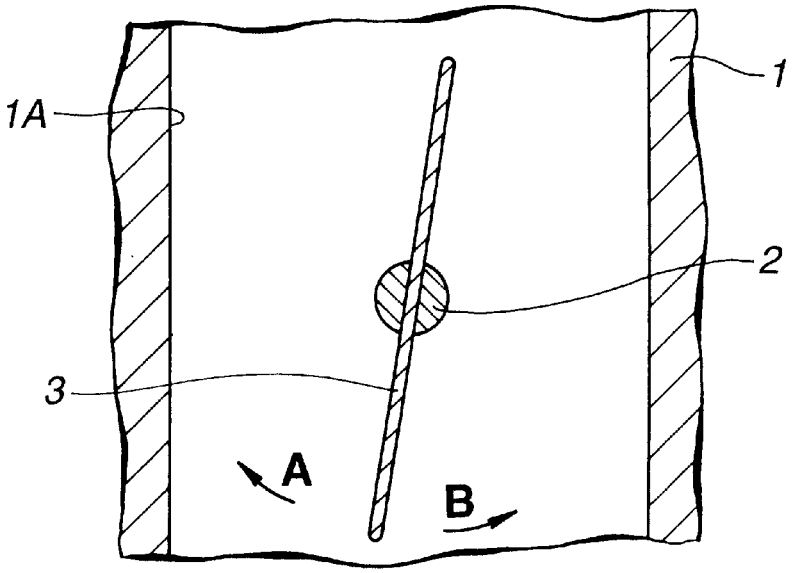
FIG. 7 is a view similar to FIG. 5, but showing the throttle valve assuming the full open position.
Figure 8:
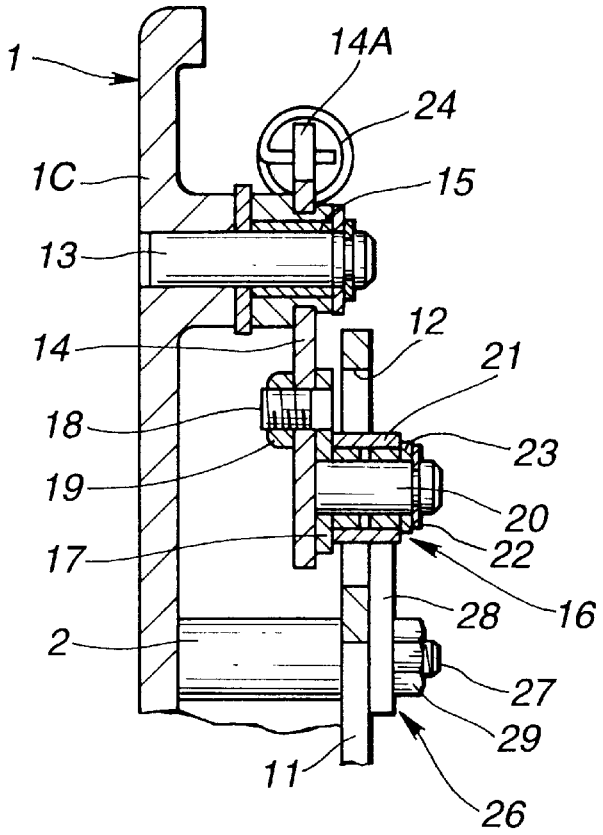
FIG. 8 is an enlarged sectional view taken along the line VIII—VIII of FIG. 2, showing a load lever and associated elements.

As is seen from FIGS. 6 and 7, the throttle valve 3 can pivot between a full-close position as shown by a phantom line in FIG. 6 and a full-open position as shown in FIG. 7. By controlling the position of the throttle valve 3, the amount of air fed to the engine is controlled.

Referring back to FIG. 1, an electric motor 4 is tightly received in the motor receiving case 1B, which is for example a DC (direct current) motor. As shown, the motor 4 has an output shaft 4A projected into the gear receiving case 1C. When the motor 4 is energized, the output shaft 4A is rotated to turn through an after-mentioned reduction gear mechanism 5 the pivot shaft 2 and thus the throttle valve 3 in a direction of the arrow A or B in FIG. 2.

As is shown in FIG. 1, the reduction gear mechanism 5 is installed in the gear receiving case 1C and operatively interposed between the output shaft 4A of the motor 4 and the pivot shaft 2.

Figure 3:
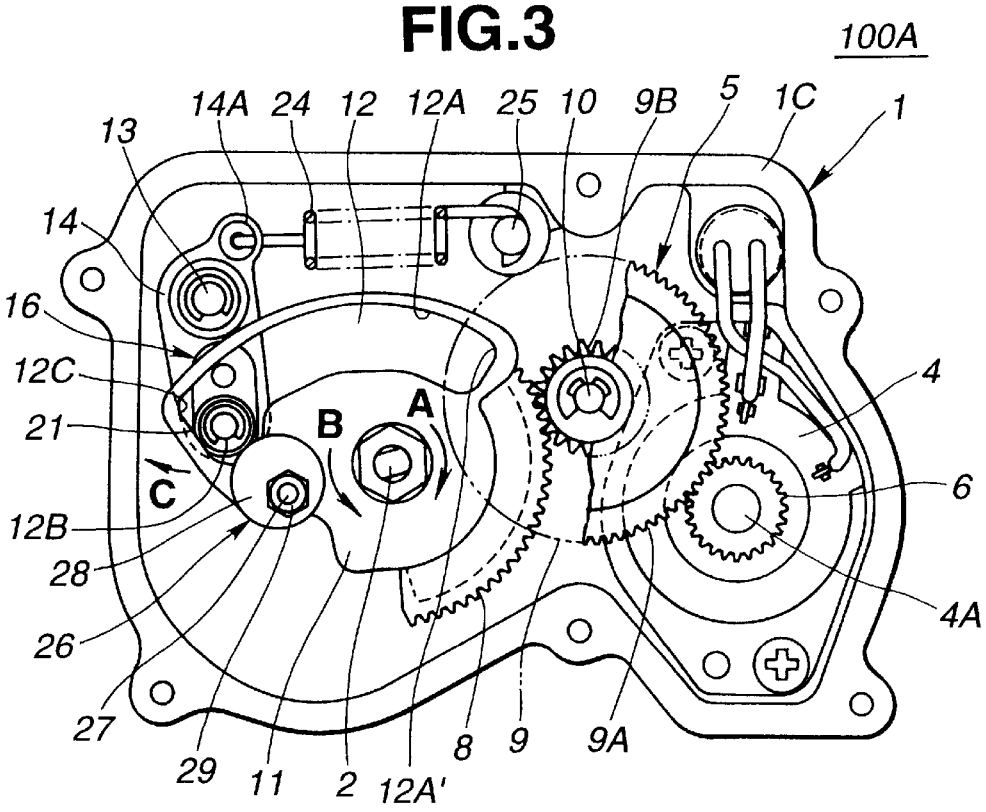
FIG. 3 is a view similar to FIG. 2, but showing a condition wherein a throttle valve assumes a close position.
Figure 4:
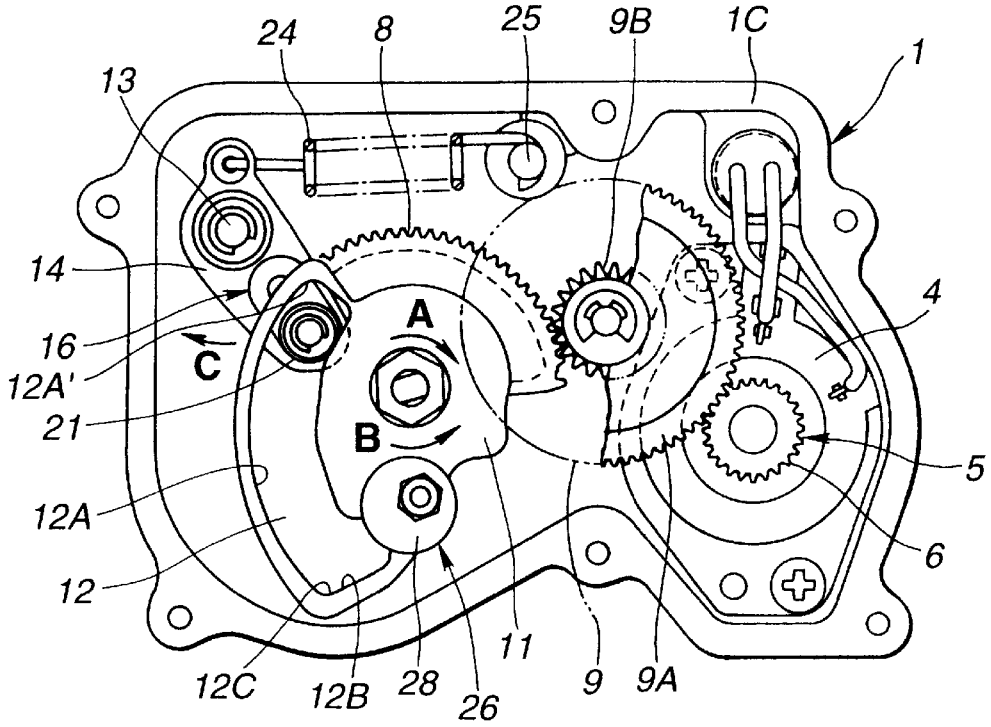
FIG. 4 is a view similar to FIG. 2, but showing a condition wherein the throttle valve assumes a full open position.

As is understood from FIGS. 2 to 4, the reduction gear mechanism 5 comprises a drive gear 6 which is secured to the output shaft 4A of the motor 4, a driven gear 8 which is welded to a cam lever 11 secured to one end of the pivot shaft 2 through a nut 7, and an intermediate gear 9. That is, a speed reduction is effected between the drive gear 6 and the intermediate gear 9, and between the intermediate gear 9 and the driven gear 8, so that a larger torque can be applied to the pivot shaft 2 of the throttle valve 3 from the motor 4.

Figure 10:
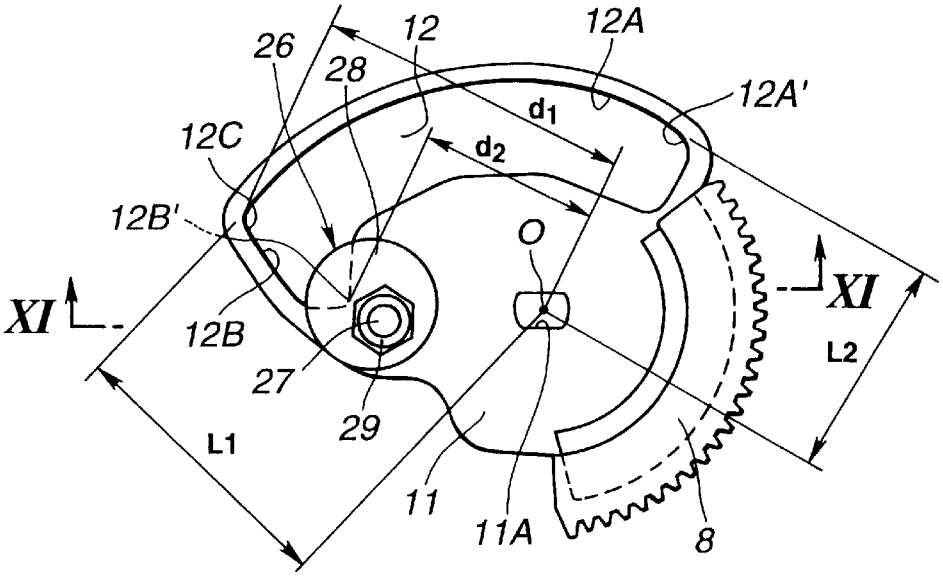
FIG. 10 is an enlarged front view of a cam lever having a close position adjuster mounted thereto.
Figure 11:
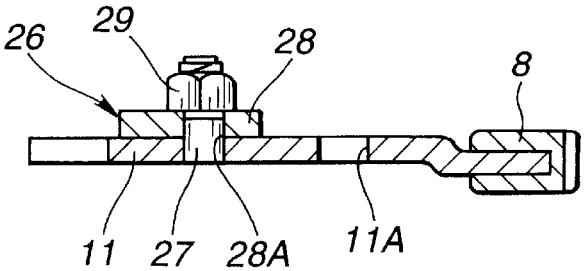
FIG. 11 is a sectional view taken along the line XI—XI of FIG. 10.

As is shown in FIGS. 10 and 11, the driven gear 8 is an arcuate gear which has its rotation center "O" in a non-circular center opening 11A formed in the cam lever 11. In other words, the driven gear 8 is concentrically connected to the cam lever 11. As shown, the driven gear 8 is welded to the cam lever 11 at a position radially apart from the opening 11A of the cam lever 11 and circumferentially apart from an after-mentioned elongate guide aperture 12 formed in the cam lever 11.

As is seen from FIGS. 3 and 4, the driven gear 8 is larger than a smaller diameter gear portion 9B of the intermediate gear 9. As is mentioned hereinabove, the cam lever 11 is secured to the end of the pivot shaft 2 by the nut 7, so that the cam lever 11, the pivot shaft 2 and the throttle valve 3 can pivot like a single unit.

As is seen from FIG. 1, for a tight connection between the cam lever 11 and the pivot shaft 2, a threaded end of the pivot shaft 2 passing through the non-circular center opening 11A of the cam lever 11 is engaged with the nut 7. Although not shown in the drawings, the threaded end of the pivot shaft 2 has a cross section matched with the non-circular center opening 11A of the cam lever 11.

As is seen from FIG. 1, the intermediate gear 9 is located between the drive gear 6 and the driven gear 8, which is rotatably connected to the throttle body 1 through a shaft 10. The intermediate gear 9 comprises a larger diameter gear portion 9A and a smaller diameter gear portion 9B which are concentrically connected to each other. As is seen from FIG. 2, the larger diameter gear portion 9A is meshed with the drive gear 6, while, as is seen from FIGS. 3 and 4, the smaller diameter gear portion 9B is meshed with the driven gear 8. Thus, a satisfied torque can be applied from the motor 4 to the driven gear 8, that is to the pivot shaft 2 of the throttle valve 3.

Figure 12:
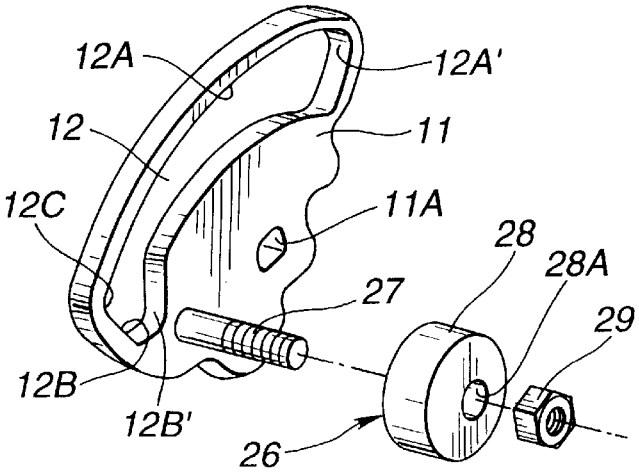
FIG. 12 is an exploded view of the cam lever and the close position adjuster.

As is seen from FIGS. 10, 11 and 12, the cam lever 11 is in the sectoral shape, which is produced by stamping a mechanically tough metal sheet. The non-circular opening 11A is formed in a generally middle portion of the cam lever 11.

As is seen from FIGS. 10 and 12, the cam lever 11 is formed at a peripheral portion thereof with an elongate guide aperture 12 which constitutes a cam surface. As will be described in detail hereinafter, a roller 21 runs in and along a peripheral edge of the elongate guide aperture 12.

As is seen from FIG. 10, the elongate guide aperture 12 comprises a longer open part 12A which extends in a circumferential direction, a shorter open part 12B and a generally V-shaped portion (viz., sharply depressed portion) 12C located between the longer and shorter open parts 12A and 12B.

It is to be noted that the distance between the longer open part 12A of the elongate guide aperture 12 and the center "O" of the non-circular opening 11A of the cam lever 11 gradually increases as the longer open part 12A nears the V-shaped portion 12C. That is, in FIG. 10, the distance "L1" between the center "O" and the V-shaped portion 12C is the longest, and the distance "L2" between the center "O" and the leading end 12A' of the longer open part 12A is the shortest. More specifically, the longer open part 12A has a smoothly curved outer peripheral edge which constitutes a part of a helical line. Due to this smoothed peripheral edge, the roller 21 rotatably mounted on an after-mentioned load lever 14 can smoothly run in the elongate guide aperture 12 between the V-shaped portion 12C and the above-mentioned leading end 12A'.

As is seen from FIG. 10, the shorter open part 12B has an outermost end near the V-shaped portion 12C and an innermost end near a connecting bolt 27 of an after-mentioned close position adjuster 26.

It is to be noted that the distance between the shorter open part 12B of the elongate guide aperture 12 and the center "O" of the non-circular opening 11A of the cam lever 11 gradually increases as the shorter open part 12B nears the V-shaped portion 12C. That is, in FIG. 10, the distance "d1" between the center "O" and the V-shaped portion 12C is the longest, and the distance "d2" between the center "O" and the leading end 12B' of the shorter open part 12B is the shortest. More specifically, like the above-mentioned longer open part 12A, the shorter open part 12B has a smoothly curved outer peripheral edge which constitutes a part of a helical line.

Figure 15:
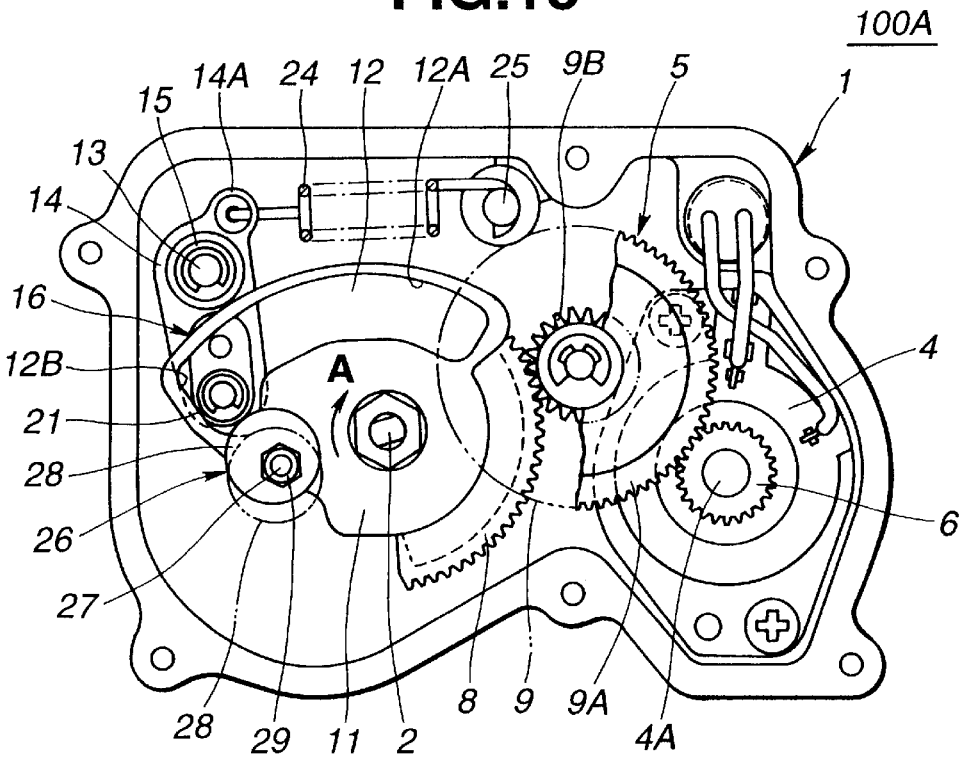
FIG. 15 is an enlarged view of FIG. 3, but showing a manner for adjusting the connecting position of the close position adjuster to the cam lever.

As is seen from FIGS. 3 and 15, when the cam lever 11 is pivoted by a certain angle in a direction to close the throttle valve 3, the roller 21 is brought into abutment with the close position adjuster 26 thereby to suppress further pivoting of the throttle valve 3 in the closing direction. That is, due to this abutment, the closing position of the throttle valve 3 is restricted.

As is seen from FIGS. 1 and 2, within the gear receiving case 1C, the load lever 14 is pivotally connected to the throttle body 1 by means of a pin 13. A bearing 15 is employed for achieving a smoothed pivoting of the load lever 14 about the pin 13. The load lever 14 is constructed of a mechanically tough metal plate and has near the pin 13 a rounded portion 14A by which an end of a biasing spring 24 is caught. With this biasing spring 24, the load lever 14 is biased to rotate about the pin 13 in the direction of the arrow "C" in FIG. 2. Various types of springs are usable as the biasing spring 24, which are, for example, flat spiral spring, compression spring, etc.,.

Figure 9:
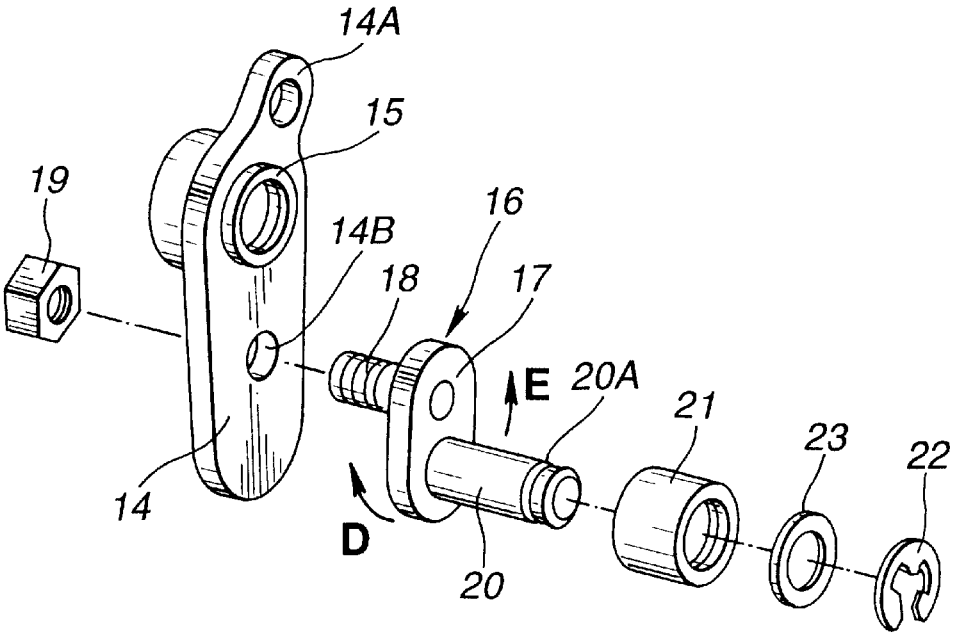
FIG. 9 is an exploded view of an intermediate position adjuster.

As is best shown in FIG. 9, the load lever 14 is formed with an opening 14B to which a connecting bolt 18 of an aftermentioned intermediate position adjuster 16 is connected with an aid of a nut 19. If desired, a so-called spline connection may be employed for the connection between the bolt 18 and the opening 14B.

As will be understood from FIG. 2, when the cam lever 11 is pivoted about an axis of the pivot shaft 2, the roller 21 on the load lever 14 is forced to run in and along the elongate guide aperture 12 of the cam lever 11 thereby pivoting the load lever 14*a* about the pin 13 in fore-and-aft directions, that is, in directions to contract and expand the biasing spring 24. That is, as is seen from FIG. 3, when the cam lever 11 is rotated in the direction of the arrow "A" to assume its rightmost angular position, the biasing spring 24 is less expanded, while, as is seen from FIG. 4, when the cam lever 11 is rotated in the direction of the arrow "B" to assume its leftmost angular position, the biasing spring 24 is highly expanded.

As is seen from FIG. 9, the intermediate position adjuster 16 comprises a holder plate 17 which has one end to which the connecting bolt 18 is secured. To the other end of the holder plate 17, there is connected a shaft 20 about which the roller 21 is rotatably disposed. The shaft 20 has at a head portion an annular groove 20A. A stop ring 22 is engaged with the annular groove 20A to hold the roller 21 on the shaft 20. A plastic washer 23 is disposed on the shaft 20 to assist a smoothed rotation of the roller 21 on the shaft 20.

As will be described hereinafter, by changing the angular position of the holder plate 17 relative to the load lever 14, the intermediate position of the throttle valve 3 is changed or adjusted. That is, by moving the holder plate 17 in the direction of the arrow "D" or "E", adjustment of the intermediate position of the throttle valve 3 is achieved. This will be seen from the drawings of FIGS. 13 and 14. Of course, the adjustment is carried out by loosening the nut 19.

As is understood from FIGS. 3 and 4, due to the force produced by the biasing spring 24, the roller 21 of the intermediate position adjuster 16 is constantly pressed against the outer periphery of the elongate guide aperture 12 of the cam lever 11. Thus, the rotation of the cam lever 11 in the directions of the arrows "A" and "B" is made against the force of the biasing spring 24. During the rotating movement of the cam lever 11, the roller 21 rolls on the peripheral edge of the elongate guide aperture 12, which reduces the frictional resistance between the cam lever 11 and the roller 21.

As is shown in FIG. 2, the other end of the biasing spring 24 is hooked to a projection 25 which is located within the gear receiving case 1C and integrally formed on the throttle body 1. Due to provision of the biasing spring 24, the load lever 14 is constantly biased to pivot about the pin 13 in the direction of the arrow "C".

Figure 5:
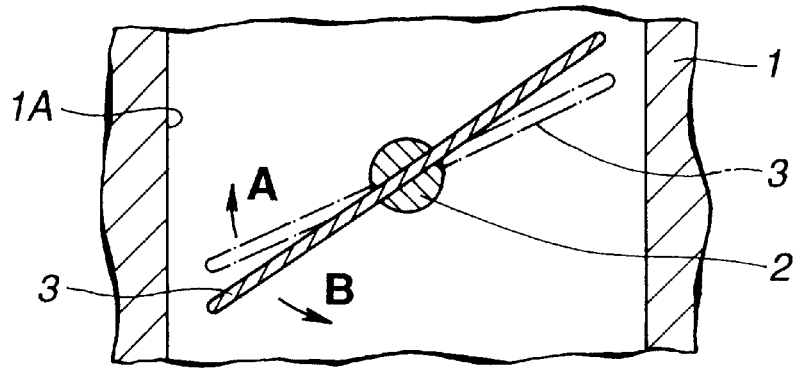
FIG. 5 is an enlarged sectional view of the throttle valve assuming an intermediate position.

As will be described in detail hereinafter, when, with the roller 21 assuming its right position in the elongate guide aperture 12 of the cam lever as is shown in FIG. 4, the electric motor 4 fails to operate, the force produced by the biasing spring 24 forces the cam lever 11 to rotate in the direction of the arrow "A" bringing the roller 21 to the V-shaped portion 12C of the elongate guide aperture 12, that is, to the position as shown in FIG. 2. With this, the throttle valve 3 is turned to the intermediate position as shown in FIG. 5.

When now the cam lever 11 is rotated from the position as shown in FIG. 2 in the direction of the arrow "A", the roller 21 on the load lever 14 is forced to roll on an outer peripheral edge of the shorter open part 12B of the elongate guide aperture 12 as is seen from FIG. 3. During this, the throttle valve 3 is turned from the intermediate position of FIG. 5 to the close position of FIG. 6.

While, when the cam lever 11 is rotated from the position as shown in FIG. 2 in the direction of the arrow "B", the roller 21 on the load lever 14 is forced to roll on the outer peripheral edge of the longer open part 12A of the elongate guide aperture 12 as is seen from FIG. 4. During this, the throttle valve 3 is turned from the intermediate position of FIG. 5 to the full-open position of FIG. 7.

The close position adjuster 26 to which the roller 21 can abut is also mounted on the cam lever 11. Due to this close position adjuster 26, the close position of the throttle valve 3 is adjusted.

As is seen from FIGS. 10 to 12, the close position adjuster 26 comprises a connecting bolt 27 secured to the cam lever 11, an eccentric metal plate 28 held by the connecting bolt 27 and a nut 29 engaged with a threaded head of the connecting bolt 27 to tightly hold the eccentric metal plate 28 on the cam lever 11. The eccentric metal plate 28 employed in the present invention is circular in shape.

It is to be noted that an opening 28A of the eccentric metal plate 28 through which the bolt 27 passes is eccentric to a center of the circular metal plate 28. However, if desired, the eccentric metal plate 28 may have other shapes, such as oval shape, polygonal shape, etc.,. In order to assure a tight connection between the metal plate 28 and the bolt 27, a so-called spline connection may be employed therebetween.

As is seen from FIG. 3, when the throttle valve 3 assumes the close position of FIG. 6, the roller 21 on the load lever 14 is in abutment with the eccentric metal plate 28. With this abutment, the throttle valve 3 is suppressed from further pivoting in the direction of the arrow "A" in FIG. 6. It is to be noted that by turning the eccentric metal plate 28 about the bolt 27 by a certain angle, the timing at which the roller 21 contacts to the eccentric metal plate 28 is changed. With this, as is seen from FIG. 6, the throttle valve 3 is permitted to take the close position between a nearly close position illustrated by a solid line and a full-close position illustrated by a phantom line. That is, by changing the angular position of the eccentric metal plate 28 relative to the cam lever 11, the close position of the throttle valve 3 can be changed or adjusted. It is to be noted that the nearly close position of the throttle valve 3 is provided for permitting the engine to operate at an idling speed. Of course, the turning of the eccentric metal plate 28 about the bolt 27 is carried out by loosening the nut 29.

As is seen from FIG. 1, a cover 30 is detachably connected to the gear receiving case 1C. With this cover 30, the reduction gear mechanism 5 in the gear receiving case 1C is protected from foreign things, such as rain drops, dusts and the like.

Denoted by numeral 31 in FIG. 1 is an acceleration degree detecting device which is mounted to the throttle body 1. The device 31 comprises a wire drum 32, a return spring 33, a wire guide 35 and a displacement sensor 36. A wire 34 extending from an accelerator pedal (not shown) of an associated motor vehicle is guided by the wire guide 35 and wound on the wire drum 32. That is, when the accelerator pedal is depressed by a driver of the vehicle, the wire drum 32 is turned against the return spring 33, and the turning valuable corresponding to the accelerator depression degree is sensed by the displacement sensor 36. The displacement sensor 36 is of a sensor including a potentiometer. The information signal (which represents the acceleration depression degree) issued from the displacement sensor 36 is fed to a control unit (not shown) of the engine. By processing the information signal, the control unit issues an instruction signal for energizing the electric motor 4 for a certain period. With this, the throttle valve 3 is pivoted to a desired position which corresponds to the accelerator depression degree.

Denoted by numeral 37 is a throttle sensor which is installed in the sensor receiving case 1D of the throttle body 1. The throttle sensor 37 is of a sensor including a potentiometer, like the displacement sensor 36. That is, the throttle sensor 37 senses the open degree of the throttle valve 3 by detecting the rotation angle of the pivot shaft 2 of the throttle valve 3. The information signal (which represents the open degree of the throttle valve 3) from the throttle sensor 37 is fed to the control unit of the engine for improving the control of the electric motor 4.

In the following, operation of the throttle valve control device will be described with reference to the drawings.

For ease of understanding, the following description will be commenced with respect to a condition wherein the throttle valve 3 assumes the intermediate position of FIG. 5. In this condition, a driver of an associated motor vehicle slightly depresses the accelerator pedal and the throttle valve control device assumes the condition as shown in FIG. 2. That is, the roller 21 on the load lever 14 is placed in the V-shaped portion of the elongate guide aperture 12 of the cam lever 11.

When now (see FIG. 1) the driver further depresses the accelerator pedal, the wire 34 is pulled and thus the wire drum 32 is turned against the return spring 33 by an angle corresponding to the depression degree of the accelerator pedal. The depression degree is sensed by the displacement sensor 36, and feeds a corresponding information signal to the control unit of the engine. Upon this, the control unit issues an instruction signal to energize the electric motor 4 to rotate in a first direction for a certain period. With this, the rotation of the motor 4 is transmitted through the reduction gear mechanism 5 to the pivot shaft 2 of the throttle valve 3. More specifically, the rotation force of the motor 4 is transmitted to the pivot shaft 2 through the output shaft 4A of the motor 4, the drive gear 6, the larger diameter gear portion 9A of the intermediate gear 9, the smaller diameter gear portion 9B of the intermediate gear 9, the driven gear 8 and the cam lever 11. The throttle valve 3 is thus pivoted to a desired angular position which corresponds to the depression degree of the accelerator pedal. During this, the cam lever 11 is rotated in the direction of the arrow "B" in FIG. 2. That is, with the rotation of the cam lever 11 in the direction of the arrow "B", the throttle valve 3 is pivoted in the direction of the arrow "B" from the intermediate position of FIG. 5 toward the full-open position of FIG. 7, and the roller 21 on the load lever 14 is forced to run in the elongate guide aperture 12 from the V-shaped portion 12C (see FIG. 2) toward the leading end 12A' (see FIG. 4) of the longer open part 12A. As is seen from FIG. 4, during this running of the roller 21 in the longer open part 12A, the load lever 14 is forced to pivot about the pin 13 in a counterclockwise direction due to the above-mentioned nature of the longer open part 12A, so that the biasing spring 24 is expanded by the load lever 14. That is, when the roller 21 is located in the longer open part 12A of the guide aperture 12, the biasing force of the biasing spring 24 is increased.

When now the driver releases his foot from the accelerator pedal, the wire drum 32 (see FIG. 1) is returned back to its rest position due to the force of the return spring 33. This return movement is sensed by the displacement sensor 36, and feeds a corresponding information signal to the control unit of the engine. Upon this, the control unit issues an instruction signal to energize the electric motor 4 to rotate in a second (or reversed) direction for a certain period. With this, the reversed rotation of the motor 4 is transmitted through the reduction gear mechanism 5 to the pivot shaft 2 of the throttle valve 3. The throttle valve 3 is thus pivoted toward the close position of FIG. 6 via the intermediate position of FIG. 5. During this, the roller 21 on the load lever 14 is forced to run back in the elongate guide aperture 12 from the longer open part 12A (see FIG. 4) toward the leading end 12B' of the shorter open part 12B (see FIG. 3) via the V-shaped portion 12C (see FIG. 2). Due to the increased biasing force accumulated by the biasing spring 24, the running of the roller 21 from the longer open part 12A to the V-shaped portion 12C is assisted by the biasing spring 24. While, the running of the roller 21 from the V-shaped portion 12C toward the leading end 12B' of the shorter open part 12B is carried out against the biasing force of the biasing spring 24 due to the above-mentioned nature of the shorter open part 12B. That is, when the roller 21 is placed in the shorter open part 12B of the guide aperture 12, the biasing force of the biasing spring 24 is also increased. When the roller 21 is brought into abutment with the eccentric metal plate 28 of the close position adjuster 26 on the cam lever 11, the running of the roller 21 in the shorter open part 12B is stopped and the throttle valve 3 assumes the close position of FIG. 6.

It is now to be noted that when the roller 21 in the guide aperture 12 is in a position other than the V-shaped portion 12C, that is, when the throttle valve 3 is in a position other than the intermediate position of FIG. 5, there is constantly produced a force by which the roller 21 is biased toward the V-shaped portion 12C, that is, by which the throttle valve 3 is biased toward the intermediate position of FIG. 5.

In order to change the close position of the throttle valve 3 for the purpose of changing the idling speed of the engine or so, the eccentric metal plate 28 of the close position adjuster 26 is somewhat turned or displaced as is described hereinabove. This will be seen from FIG. 15 which shows two positions of the eccentric metal plate 28 by solid and phantom lines respectively. That is, when the eccentric metal plate 28 assumes the position as illustrated by the solid line, the throttle valve 3 takes the close position as illustrated by the solid line in FIG. 6, while, when the eccentric metal plate 28 assumes the position as illustrated by the phantom line, the throttle valve 3 takes the full-close position as illustrated by the phantom line in FIG. 6.

When the engine is stopped, the electric motor 4 becomes deenergized. Upon this, the biasing force accumulated by the biasing spring 24 forces the roller 21 to run toward the V-shaped portion 12C of the elongate guide aperture 12 from the shorter open part 12B or the longer open part 12A. Due to this movement of the roller 21, the cam lever 11 is forced to assume the position as shown in FIG. 2 causing the throttle valve 3 to take the intermediate position of FIG. 5.

Figure 13:
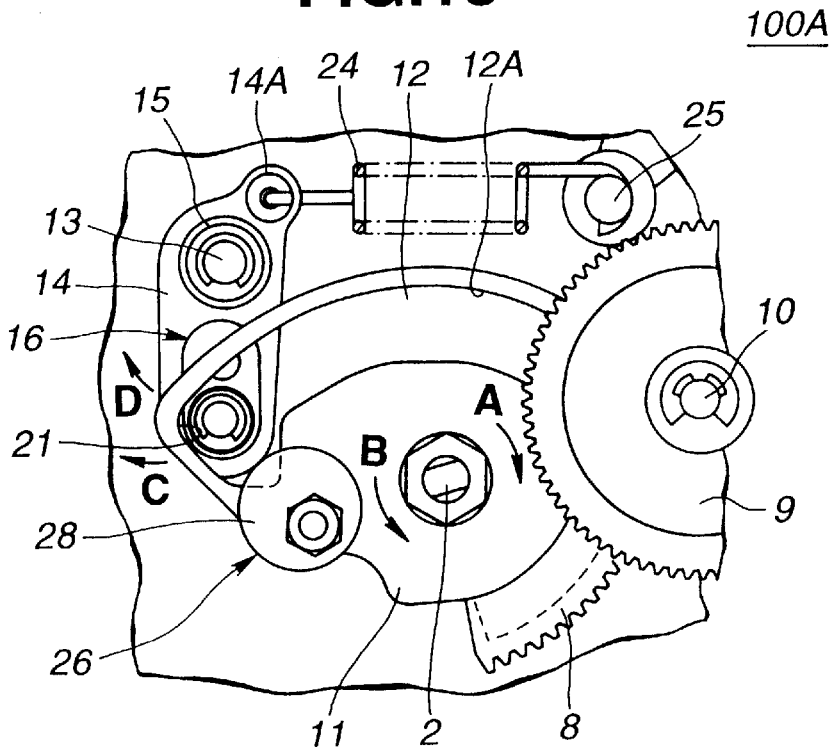
FIG. 13 is an enlarged view of an essential portion of FIG. 2, showing the cam lever, the load lever, the close position adjuster and the intermediate position adjuster.
Figure 14:
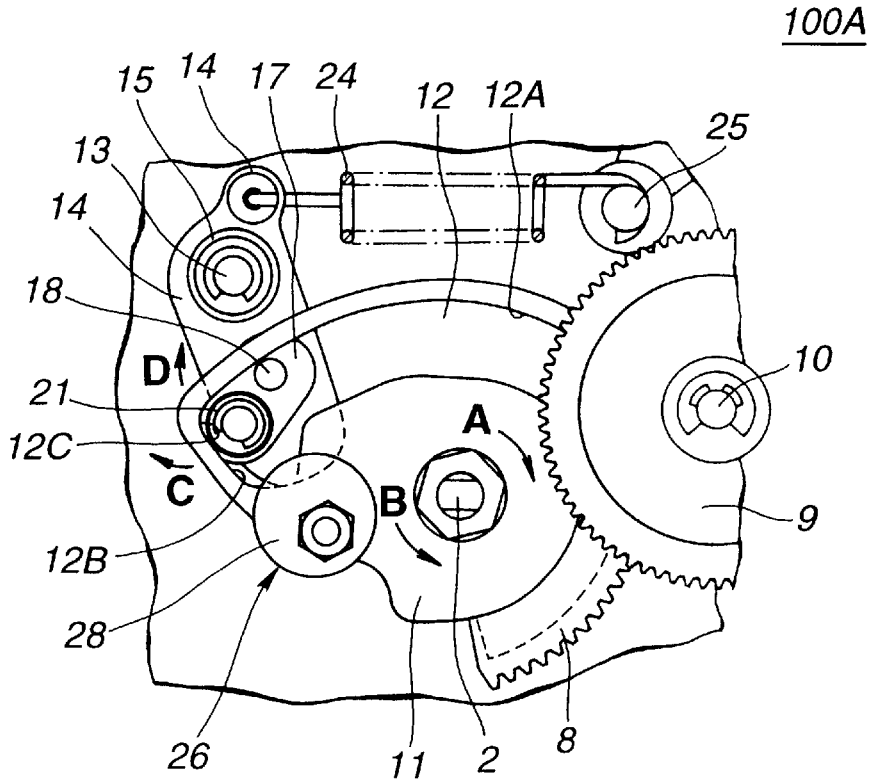
FIG. 14 is a view similar to FIG. 13, but showing a condition wherein the connecting position of the intermediate position adjuster to the load lever changes.

As is mentioned hereinabove, in order to adjust the intermediate position of the throttle valve 3, the angular position of the holder plate 17 relative to the load lever 14 is changed. That is, for example, when (see FIGS. 13 and 14) the holder plate 17 is displaced in angle in the direction of the arrow "D" from the position as shown by FIG. 13 to the position as shown by FIG. 14, the angular position of the cam lever 11 assumed when the roller 21 is put in the V-shaped portion 12C of the elongate guide aperture 12 is changed. With this, the throttle valve 3 (see FIG. 5) changes its position from the position as shown by the solid line to the position as shown by the phantom line.

In the following, advantages of the throttle valve control device of the first embodiment 100A will be described.

Due to the above-mentioned unique arrangement including the cam lever 11 with the elongate guide aperture 12, the roller 21 movably received in the elongate guide aperture 12, the load lever 14 operatively interposed between the roller 21 and the biasing spring 24, the throttle valve 3 is assuredly pivoted to the intermediate position of FIG. 5 when the engine is stopped and/or the electric motor 4 fails to be energized. Thus, undesired freeze-up of the throttle valve 3 in winter is prevented and undesired engine stop due to the failure of the electric motor 4 is suppressed.

Due to provision of the intermediate position adjuster 16, the intermediate position (see FIG. 5) of the throttle valve 3 can be adjusted.

Due to provision of the close position adjuster 26, the close position (see FIG. 6) of the throttle valve 3 can be adjusted.

The throttle body 1 has the motor receiving case 1B, gear receiving case 1C and sensor receiving case 1D which are integrally provided thereto. Thus, various parts, such as the electric motor 4, reduction gear mechanism 5, throttle sensor 37, etc., are stably installed in the cases, which improves the reliability of the throttle valve control device. Due to the same reason, the throttle valve control device can be constructed compact in size.

Due to usage of the reduction gear mechanism 5, sufficient torque for actuating the throttle valve 3 is obtained even if the electric motor 4 is of a lower output type.

Since the cam lever 11 is detachably connected to the pivot shaft 2 of the throttle valve 3 by means of the nut 7, the cam lever 11 is easily replaced with another cam lever. This means that the throttle valve control device of the invention can be applied to various types of internal combustion engines by only changing the cam lever 11.

Figure 16:
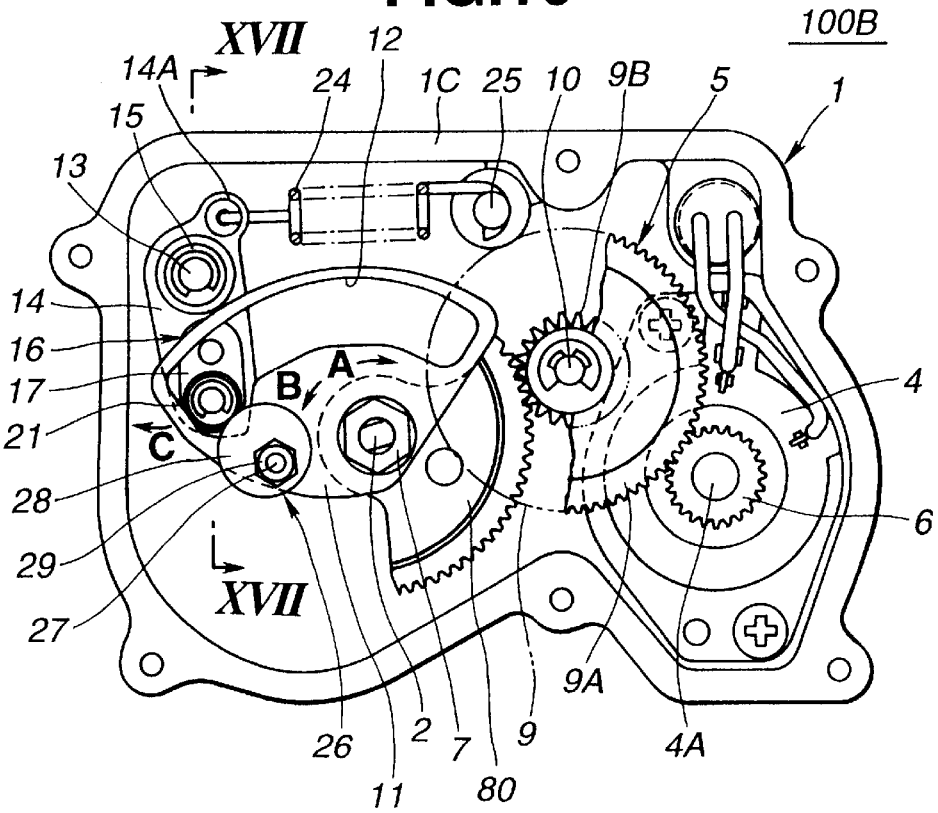
FIG. 16 is a view similar to FIG. 15, but showing a throttle valve control device of a second embodiment of the present invention.
Figure 17:
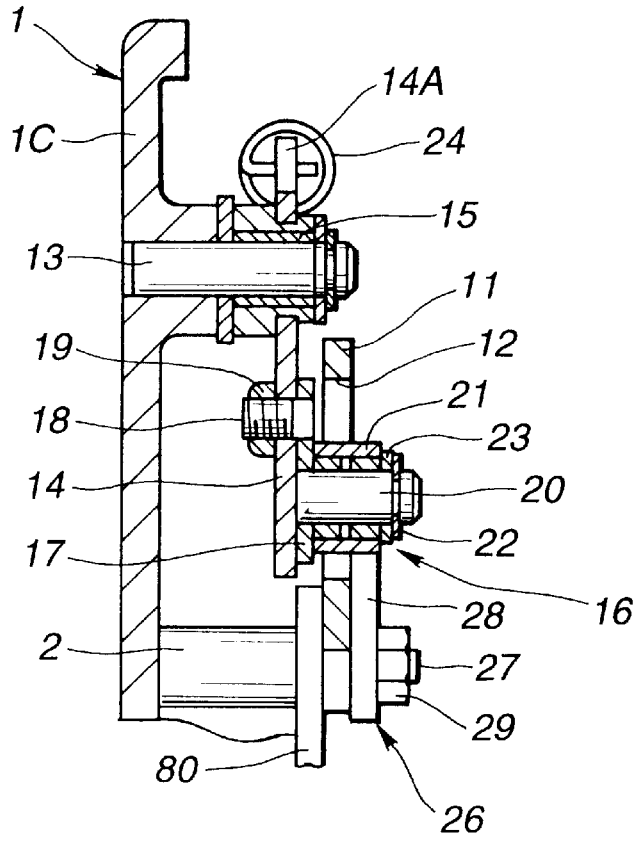
FIG. 17 is an enlarged sectional view taken along the line XVII—XVII of FIG. 16, showing a load lever, a close position adjuster and associated elements.
Figure 18:
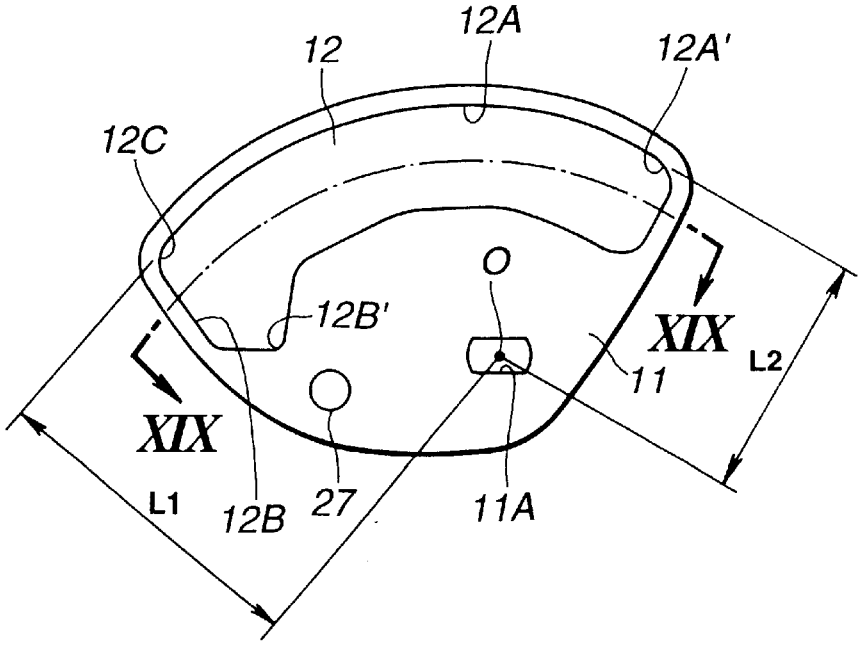
FIG. 18 is an enlarged view of a cam lever employed in the second embodiment.
Figure 19:
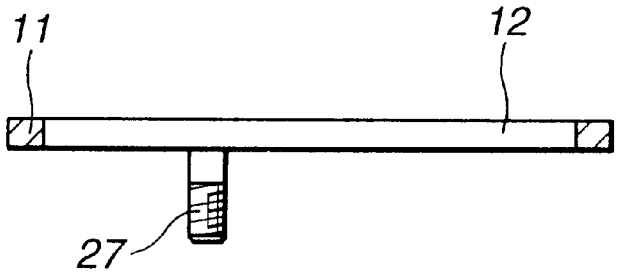
FIG. 19 is a sectional view taken along the line XIX—XIX of FIG. 18.

Referring to FIGS. 16 to 21, particularly FIG. 16, there is shown a throttle valve control device 100B which is a second embodiment of the present invention.

Since the device of the second embodiment 100B is similar in construction to that of the above-mentioned first embodiment 100A, only parts and constructions which are different from those of the first embodiment 100A will be described in detail in the following. Parts and constructions similar to those of the first embodiment 100A are denoted by the same numerals.

In the second embodiment 100B, a separate driven gear 41 is employed in place of the driven gear 8 of the first embodiment 100A. As is described hereinabove, the driven gear 8 of the first embodiment 100A is welded to the cam lever 11.

While, in the second embodiment 100B, as is best shown in FIG. 16, the driven gear 80 is secured to pivot shaft 2 by means of the nut 7.

Figure 20:
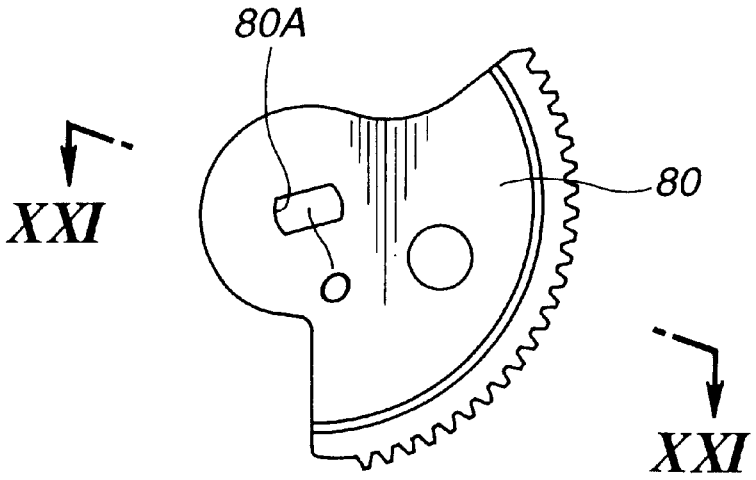
FIG. 20 is an enlarged view of a driven gear employed in the second embodiment.
Figure 21:
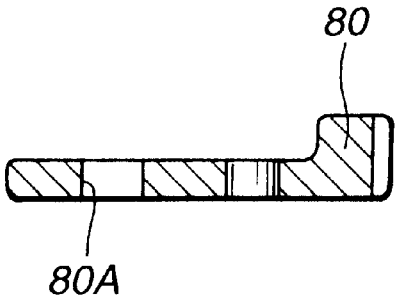
FIG. 21 is a sectional view taken along the line XXI—XXI of FIG. 20.

As is shown in FIG. 20, the driven gear 80 has a semicircular base portion (no numeral) in which a non-circular center opening 80A is formed.

As is seen from FIG. 16, the driven gear 80 is put behind the cam lever 11 having their non-circular center openings 80A and 11A mated and the threaded end portion of the pivot shaft 2 passing through the mated openings 80A and 11A is engaged with the nut 7. That is, both the follow gear 80 and the cam lever 11 are secured to the pivot shaft 2 by the nut 7.

In the following, modifications of the present invention will be briefly described.

As is seen from FIGS. 12 and 16, in the above-mentioned first and second embodiments 100A and 100B, the connecting bolt 27 of the close position adjuster 26 is secured to the cam lever 11. However, if desired, the connecting bolt 27 may be provided on an eccentric portion of the metal plate 28. In this case, the cam lever 11 is provided with an opening for receiving the connecting bolt 27. Tight connection between the connecting bolt 27 and the cam lever 11 is made by the nut 29. Furthermore, if desired, the cam lever 11 may be provided between the shorter open part 12B of the guide aperture 12 and the non-circular center opening 11A with a plurality of aligned openings each having a size to receive the connecting bolt 27. In this case, adjustment of the close position of the throttle valve 3 can be made by engaging the bolt 27 with a selected one of the aligned openings.

As is seen from FIG. 9, in the above-mentioned first and second embodiments 100A and 100B, for changing or adjusting the intermediate position of the throttle valve 3, there is need of changing the angular position of the holder plate 17 relative to the load lever 14. If desired, the load lever 14 may be provided with a plurality of aligned openings each having a size to receive the connecting bolt 18. In this case, adjustment of the intermediate position of the throttle valve 3 can be made by engaging the bolt with a selected one of the aligned openings.

In the above-mentioned first and second embodiments 100A and 100B, the electric motor 4 is used for actuating the throttle valve 4. However, if desired, a hydraulic actuator may be used in stead of the electric motor 4.

It is to be understood that, although the invention has been described with specific reference to particular embodiments thereof, it is not to be so limited since changes and alternations therein may be made within the full intended scope of this invention as defined by the appended claims.

What is claimed is:

1. A throttle valve control device for controlling a throttle valve which pivots to assume a close position, an intermediate position and an open position, comprising:

a throttle body having a throttle chamber formed therethrough;

a pivot shaft rotatably held by said throttle body and extending across said throttle chamber, said throttle valve being secured to said throttle shaft to pivot therewith;

an actuator mounted to said throttle body to produce a power to drive the pivot shaft;

a reduction gear mechanism arranged between said actuator and said pivot shaft to reduce a speed of an actuation motion applied to the pivot shaft from said actuator;

a cam lever constituting a part of said reduction gear mechanism, said cam lever being secured to said pivot shaft to pivot therewith and having a cam surface;

a cam follower structure pivotally connected to said throttle body and constantly contacting said cam surface to be pivoted;

biasing means for biasing said cam follower structure in a direction to press a part of said cam follower structure against said cam surface; and a close position adjuster mounted on said cam lever to adjust the close position of said throttle valve, said close position adjuster being brought into abutment with said part of said cam follower structure thereby to stop further pivoting of the cam lever when the cam lever is pivoted in a direction to close the throttle valve.

2. A throttle valve control device as claimed in claim 1, in which said cam surface is defined by a periphery of an elongate guide opening formed in said cam lever.

3. A throttle valve control device as claimed in claim 2, in which said cam surface of said cam lever is formed with a sharply depressed portion into which said part of said cam follower structure is put when said throttle valve is pivoted to the intermediate position, and in which said biasing means constantly biases said part of said cam follower structure toward the sharply depressed portion.

4. A throttle valve control device as claimed in claim 3, in which said close position adjuster comprises:

an eccentric plate connected to said cam lever, said eccentric plate being capable of contacting with said part of said cam follower structure; and first position changing means for changing the position of said eccentric plate relative to said cam lever.

5. A throttle valve control device as claimed in claim 4, in which said first position changing means comprises:

a connecting bolt secured to said cam lever, said connecting bolt having a threaded end portion;

an opening formed in said eccentric plate, through which said connecting bolt passes; and a nut engaged with said threaded end portion of the connecting bolt to tightly hold the eccentric plate on said cam lever.

6. A throttle valve control device as claimed in claim 5, in which said eccentric plate is circular in shape, and in which said opening of the circular eccentric plate is formed in an eccentric portion of the circular eccentric plate.

7. A throttle valve control device as claimed in claim 3, in which said cam follower structure comprises:

a load lever pivotally connected to said throttle body, said load lever having one end pulled by said biasing means; and an intermediate position adjuster mounted on said load lever to adjust the intermediate position of said throttle valve, said intermediate position adjuster being pressed against the cam surface of said cam lever due to the force of said biasing means, so that under pivoting of said cam lever, said intermediate position adjuster is forced to run or and along said cam surface thereby pivoting said load lever.

8. A throttle valve control device as claimed in claim 7, in which said intermediate position adjuster comprises:

a holder plate connected to said load lever;

second position changing means for changing the position of said holder plate relative to said load lever;

a roller rotatably disposed on said holder plate, said roller plate being pressed against the cam surface of said cam lever due to the force of said biasing means.

9. A throttle valve control device as claimed in claim 8, in which said second position changing means comprises:

a connecting bolt secured to said holder plate, said connecting bolt having a threaded end portion;

an opening formed in said load lever, through which said connecting bolt passes; and a nut engaged with said threaded end portion of the connecting bolt to tightly hold the holder plate on said load lever.

10. A throttle valve control device as claimed in claim 1, in which said reduction gear mechanism comprises:

a drive gear connected to an output member of said actuator;

a driven gear secured to said cam lever to rotate therewith; and an intermediate gear having a larger diameter gear portion meshed with said drive gear and a smaller diameter gear portion meshed with said driven gear.

11. A throttle valve control device as claimed in claim 10, in which said driven gear is secured to said cam lever through welding.

12. A throttle valve control device as claimed in claim 10, in which said driven gear is secured to said cam lever by means of bolt-and-nut.

13. A throttle valve control device as claimed in claim 2, in which said elongate guide opening of said cam lever comprises:

a longer open part;

a shorter open part; and a generally V-shaped portion through which said longer and shorter open parts are connected.

14. A throttle valve control device as claimed in claim 13, in which the distance between the longer open part and a rotation center of said cam lever gradually increases as the longer open part nears said V-shaped portion, and in which the distance between the shorter open part and said rotation center of said cam lever gradually increases as the shorter open part nears said V-shaped portion.

15. A throttle valve control device as claimed in claim 1, in which said actuator is an electric motor having an output shaft, and in which said reduction gear mechanism comprises a drive gear connected to said output shaft of said electric motor; a driven gear secured to said cam lever to rotate therewith; and an intermediate gear having a larger diameter gear portion meshed with said drive gear and a smaller diameter gear portion meshed with said driven gear.

* * * * *